United States Patent [19]

Wagner

[11] 4,252,387

[45] Feb. 24, 1981

[54] STORAGE CHEST WITH HIDDEN COMPARTMENT

[76] Inventor: Wayne E. Wagner, 11766 Ventura Ave., Ojai, Calif. 93023

[21] Appl. No.: 63,760

[22] Filed: Aug. 6, 1979

[51] Int. Cl.[3] ..... F16B 12/00

[52] U.S. Cl. ..... 312/204; 312/302

[58] Field of Search ..... 312/204, 231, 330, 333, 312/302

[56] References Cited

U.S. PATENT DOCUMENTS

| | | | |
|---|---|---|---|
| 1,512,937 | 10/1924 | Knaster | 312/204 |
| 1,654,616 | 1/1928 | Spann | 312/204 |
| 3,207,565 | 9/1965 | Scharge | 312/204 |
| 3,697,147 | 10/1972 | Schulte | 312/204 |

*Primary Examiner*—Casmir A. Nunberg

*Attorney, Agent, or Firm*—Kenneth J. Hovet

[57] ABSTRACT

A concealed compartment in a storage chest is provided. The compartment is located in the lower portion of the chest and is disguised with a movable bottom faceboard. The faceboard is preferrably provided with decorative molding strips to conceal its attachment to the chest. In use the molding strips are detachable allowing the faceboard to be moved away and provide access to the hidden compartment.

10 Claims, 5 Drawing Figures

STORAGE CHEST WITH HIDDEN COMPARTMENT

BACKGROUND OF THE INVENTION

1. Field of the Invention

The present invention relates to items of furniture and, more particularly, to a storage chest having a hidden compartment for concealing valuables.

2. Description of the Prior Art

The modification of household furniture to provide a hidden compartment is a desirable way for one to inhibit the loss of valuables through theft and burglaries. Many ingenious techniques have evolved for altering tables, drawers, cabinets, desks and bureaus to include a secret repository. A large number of the techniques involve the use of false drawer fronts which are ornamented to match the surrounding decor. The false front is commonly slid aside to reveal a safety box. Typical of such patents are those by Shannon, U.S. Pat. Nos. 331,163 and 375,574.

A combination safe is hidden in a desk with access obtained by sliding away a side panel and false corner post. This is shown in U.S. Pat. No. 1,512,937. Many other techniques utilize versions of the false bottom drawer. Note U.S. Pat. No. 723,050 and 2,362,017.

While many of the prior art patents disclose novel ways to incorporate secret compartments in items of furniture, the furniture itself frequently must include bulky construction to encompass the compartment in an unobtrusive manner. Also the furniture must oftentimes be specially designed in its entirety to enable the inclusion of the extra hidden compartment. Still further, special slides, levers, pins, pivots and wood construction are necessary to the design of the compartment. All of the above unquestionably add to the cost of the furniture and complicate the usage of and access to the compartment.

SUMMARY OF THE INVENTION

The present invention provides for the effective concealment of a special repository for valuables in a storage chest. No unusual mechanisms or wood construction are needed and the compartment fills an already existing empty space common to storage chests. As such, a highly efficient, inexpensive and effective means for storing valuables away from the eye of an intruder is disclosed.

The invention utilizes a movable member such as a faceboard overlying an opening in the chest. Frequently, such space can be found above, below or between the chest drawers. If the chest is the type having only a hinged top cover without drawers, then the free space is found behind the bottom molding. In any case, no extra space is needed to carry out the objectives of the invention.

The faceboard can be movably attached to the chest with hinges, magnets, cabinet latches or the like. The exact attachment means are a mere matter of choice since special advantage of the invention resides in the use of one or more movable molding strips which overlie and conceal whatever attachment means are used. The strip(s) correspond to the decor of the chest and can also function to conceal peripheral openings defined by any separation between the chest structure and the movable member.

DESCRIPTION OF THE PREFERRED EMBODIMENTS

Figure 1:
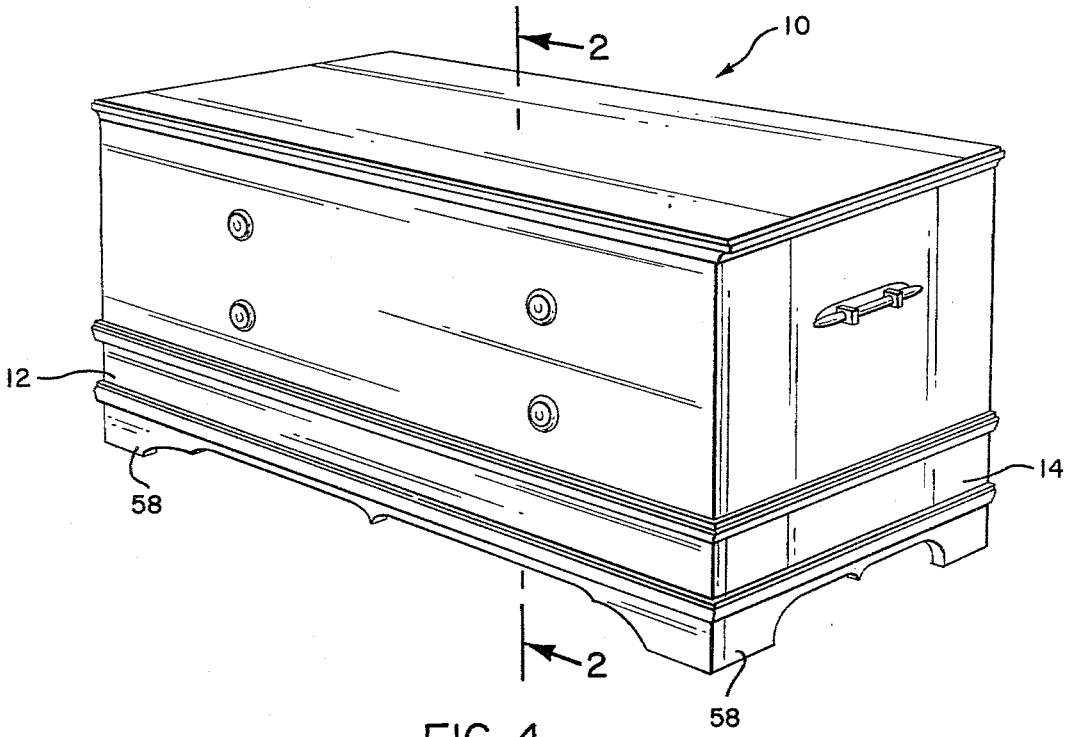
FIG. 1 is a front perspective view of a storage chest containing a hidden compartment in accordance with the present invention.
Figure 2:
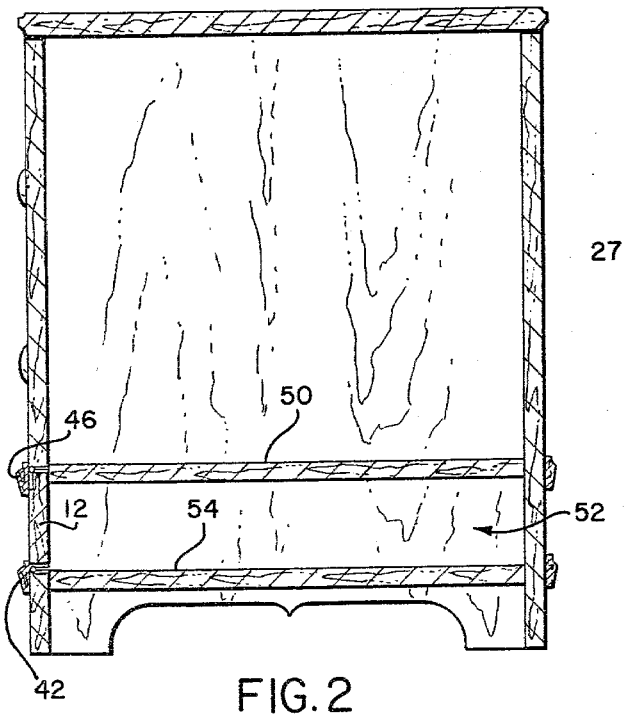
FIG. 2. is a cross-section taken along lines 2—2 of FIG. 1.

With reference now to the drawings and, more particularly, to FIGS. 1–4 thereof, a storage chest is shown generally by reference numeral (10). For purposes of the present invention the chest need not be any particular size, shape or style and may have no drawers or a plurality of such whereby the present invention will work equally well with any type. As is common to such storage chest, corner leg members (58) are used to support the chest (10) and provide an overall decorative appearance.

An essential feature of the present invention resides in the use of a movable member such as faceboard (12) which is located across the front face of the chest shown in FIG. 1. Such member, however, could work equally well as a movable sideboard shown by reference numeral (14). The movable board (12) covers an opening (16) within the chest, providing access to compartment (52). In the embodiment shown, the compartment periphery is defined by members (12) and (14) and their opposing counterparts (not shown). The compartment is enclosed by chest bottom (50) and floor member (54).

The opening (16) is defined by top edge (18) and bottom edge (20). The ends of the opening are defined by opposing side edges (22,24). The movable member (12) is sized to completely enclose the opening (16) and, in the preferred embodiment, the opposing side edges may be beveled to engage corresponding beveled surfaces (26,28) of the movable member.

The movable member (12) is provided with a connection to said chest which may comprise any known attachment means such as latches, magnets, various types of fasteners and hinges. In the preferred embodiment, hinges (30) are shown connecting the movable member (12) and lower edge (29) to the chest opening bottom edge (20). The hinges are connected to the movable member in a manner to allow such member to rotate outwardly and downwardly from the opening (16) in the manner shown by phantom arrows A in FIG. 3.

Figure 4:
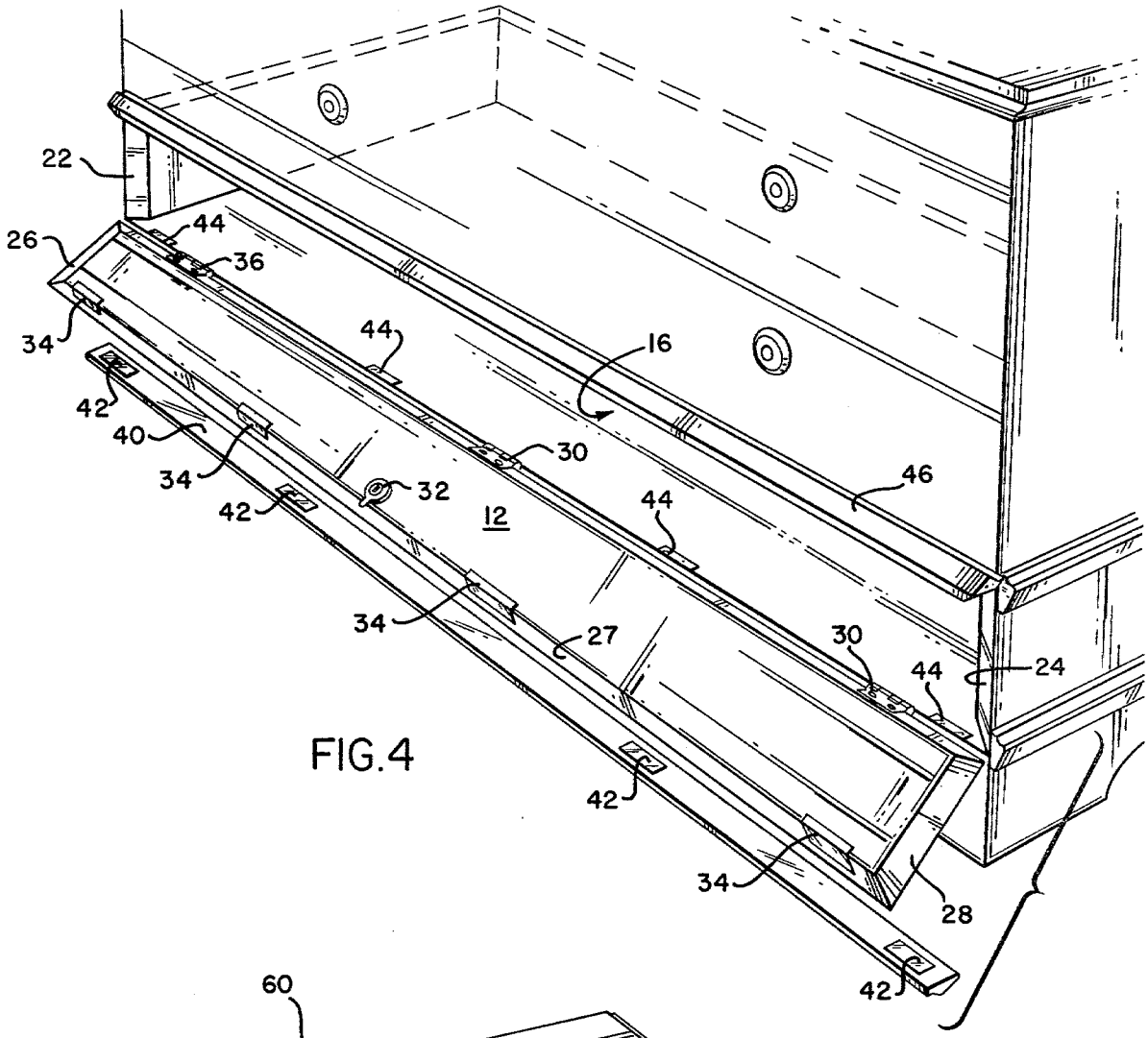
FIG. 4 is an enlarged fragmentary perspective view showing the hidden compartment of the chest in FIG. 1 in an open position.

For additional security and convenience, the movable member is provided with a means to releaseably connect it to the chest structure by locking mechanisms well known in the art. As best shown in FIG. 4, the locking mechanism comprises one component (32) secured to the top edge (27) of the movable member with a corresponding member secured to the chest structure adjacent top edge (18) of the opening. Such locking mechanism may be a combination lock or a key lock type of mechanism.

Additionally, in the preferred embodiment and particularly in the movable member (12) is of a thin material, magnetic means shown by reference numeral (34) may be located along edges (27) and (18) to further enhance a close-fitting connection between member (12) and the chest structure.

An important aspect of the present invention resides in the use of decorative means (40) to conceal the connection shown as hinges (30). In the preferred embodiment the decorative means comprises an elongated molding strip (40) about equal in length to the movable member having embedded therein magnets shown by reference numeral (42). The magnets are spaced apart along the length of the molding strip and engage counterparts (44) embedded along the bottom edge (20) of the opening. In this manner it will be apparent from FIGS. 2 and 3 that the strip (40) will overlie the joint formed between the bottom edge (20) of the opening and the bottom edge (29) of the movable member.

In a similar fashion, another molding strip (46) is provided having sufficient width to overlie the locking mechanism (32) adjacent the top edge (27) and movable member (12). The strip is also of sufficient length to cover the joint defined as the clearance between the top edge (27) and upper edge (18) of opening (16). The upper molding strip (46) may be secured to the joint by any of the aforementioned attachment means.

Figure 3:
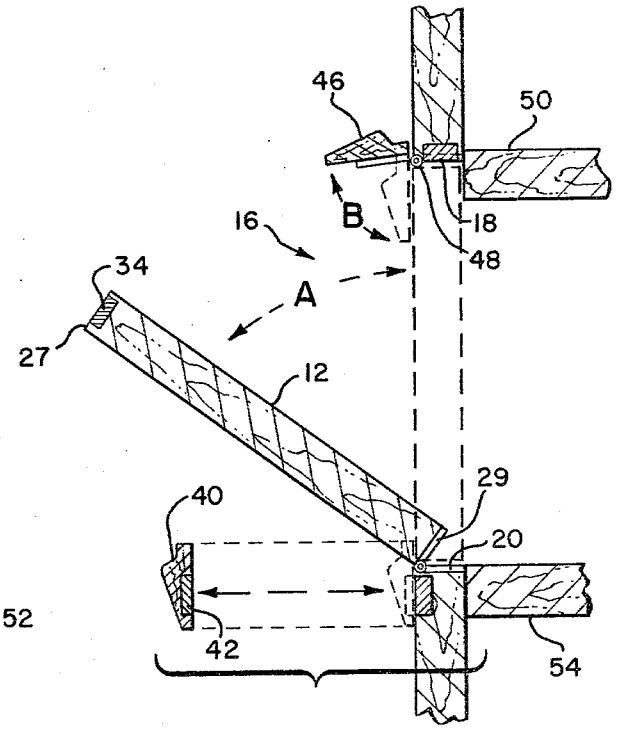
FIG. 3 is an enlarged fragmentary cross-section view taken from FIG. 2 partially exploded showing the operation of the hidden compartment.

As shown in the preferred embodiment of FIG. 3, the attachment means comprises hinges (48) which are spaced apart along the length of the strip (not shown). Preferably, the hinges are embedded into the upper edge (18) of the opening whereby the upper molding (46) will rotate outwardly and upwardly as shown in the phantom arrows B in FIG. 3. It may be desirable to embed magnets or metal plates (not shown) in the strip to draw the molding flat against the movable member. If metal plates are used, they should be located adjacent magnets (34).

As mentioned hereinabove, storage chests are provided with legs shown in FIG. 1 by reference numeral (58) which offset the chest above ground and present a more decorative appearance. However, in the embodiment of FIG. 5 chest (60) is shown, wherein sideboards (62) are used for support and faceboard (68) is used for concealment. The faceboard presents a solid outward appearance while concealing compartment (74). The compartment is provided with bottom (64) and includes vertical spacers (66). Such spacers are optional and operate to separate the compartment into storage areas and further act as support for the bottom member (64). The compartment is further defined by the opposing sideboards (62) and a chest bottom member (not shown) similar to board (50) in the FIGS. 1–4 embodiment.

Figure 5:
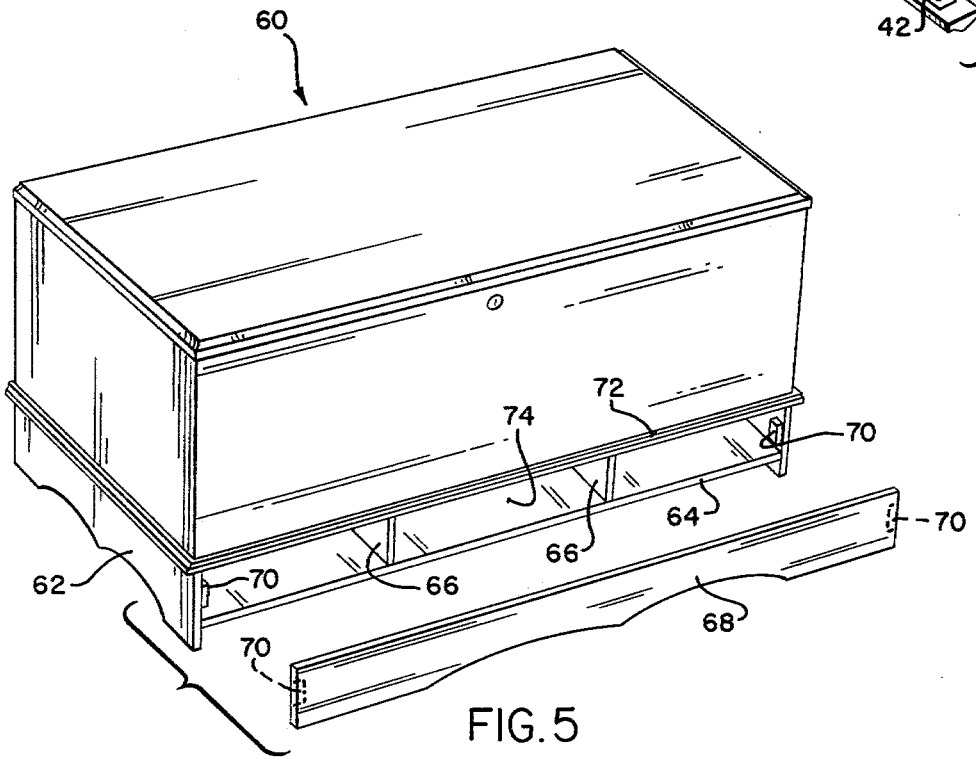
FIG. 5 is an exploded perspective view of a modified version of the present invention.

The faceboard member may be held in place by any of the attachment means described hereinabove. As shown in FIG. 5, magnets (70) are used to secure the faceboard in place over the hidden compartments. In this embodiment it is expected that the opposing side edges of the faceboard may be beveled in the same manner as the corresponding opposing end portions (22,25,26, and 28) shown in FIG. 4 so that a finished appearance will be presented.

Additionally, the molding strip (72) may be arranged or have sufficient thickness to overhang the top edge of the compartment opening in a manner to conceal the joint from an observer looking down. In this way, there may be no need for the strip to be removable. It will be appreciated, however, that the strip (72) may be constructed and operate in the same manner as strip (46). Also, it will be understood that while the drawings and description are particularly concerned with the movement of front-facing baseboards and molding strips, it is within the scope of the present invention to have the side baseboards and molding strips operate in an identical manner and achieve the objectives of the invention.

While the invention has been described with respect to preferred embodiments, it will be apparent that other modifications and improvements may be made without departing from the intents and purposes of the invention. Accordingly, the invention is not to be limited by the specific embodiments, but only the scope of the appended claims.

What is claimed is:

1. In a storage chest wherein the improvement comprises a hollow compartment in said chest having an access opening;

a movable member having a connection to said chest and covering said opening; and, decorative meas comprising at least one molding strip overlying said connection and being detachable therefrom to allow movement of said member and access to said compartment.

2. The chest in claim 1 wherein said movable member comprises a portion of the front or side structure of said chest and said connection includes hinge means connecting said member to said chest.

3. The chest of claim 2 wherein said decorative means includes at least one molding strip located over said hinge means in a manner to conceal the presence thereof.

4. The chest of claim 1 including a latching means attached to said movable member and said chest for releaseable interconnection therebetween.

5. The chest of claim 4 wherein said latching means comprises a locking mechanism having one component embedded in said movable member and a corresponding component secured to said chest.

6. The chest of claim 5 including a second decorative means overlying said latching means in a manner to conceal the presence thereof.

7. The chest of claim 6 wherein said second decorative means comprises at least one molding strip, said strip being secured to said chest by hinge means.

8. The chest of claim 1 wherein said access opening is in the lower portion of said chest and has a top edge and a bottom edge with opposing ends defining the opening; said top edge having a molding strip movably mounted thereover to conceal said edge; said connection having an attachment to said bottom edge.

9. The chest of claim 1 wherein said access opening has a top edge and a bottom edge with opposing ends defining the opening; said top edge having a molding strip hingedly attached thereto in a manner to allow the outward and upward rotation thereof from said opening; said bottom edge having hinge means connecting said movable member in a manner to allow the outward and downward rotation thereof from said opening.

10. In a storage chest wherein the improvement comprises a hollow compartment in the lower portion of said chest having an access opening, said opening having a top edge a bottom edge with opposing side edges defining the periphery thereof;

a molding strip mounted adjacent and above said top edge; and, a removable baseboard releasably connected to said chest and covering said openings.

* * * * *